United States Patent [19]

Anderle et al.

[11] Patent Number: 4,463,536

[45] Date of Patent: Aug. 7, 1984

[54] DECORATIVE CEILING OR WALL

[75] Inventors: Joseph A. Anderle, Clifton; James Dodich, New Milford, both of N.J.

[73] Assignee: Levolor Lorentzen, Inc., Lyndhurst, N.J.

[21] Appl. No.: 259,658

[22] Filed: May 1, 1981

[51] Int. Cl.[3] ..... E04B 5/52

[52] U.S. Cl. ..... 52/488; 52/473

[58] Field of Search ..... 52/460, 473, 474, 478, 52/484, 486, 488, 669, 818

[56] References Cited

U.S. PATENT DOCUMENTS

| | | | |
|---|---|---|---|
| 2,842,811 | 7/1958 | Weeks | 52/474 |
| 3,277,622 | 10/1966 | Jensen | 52/484 |
| 3,336,711 | 8/1967 | Menke | 52/473 |
| 3,628,298 | 12/1971 | Sicklen | 52/669 |
| 3,678,641 | 7/1972 | Englund et al. | 52/484 |
| 4,270,327 | 6/1981 | Van Leeuwen | 52/484 |
| 4,328,653 | 5/1982 | Anderle | 52/460 |

*Primary Examiner*—Peter M. Caun

[57] ABSTRACT

A decorative ceiling or wall covering system having carriers to be affixed to the ceiling or wall, and panels extending essentially transversely to the carriers. Tabs are integrally provided on each carrier for connecting the panels thereto, and are respectively located at opposite longitudinal marginal portions of the carrier at predetermined substantially equal distances and shaped to hold the panels in place on the carrier.

4 Claims, 9 Drawing Figures

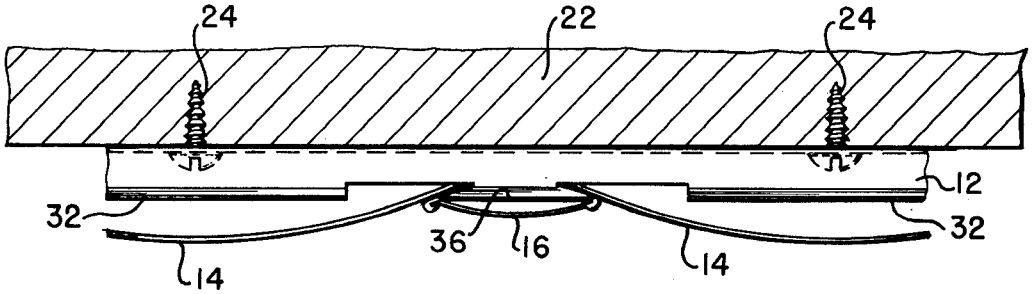
FIG. 4
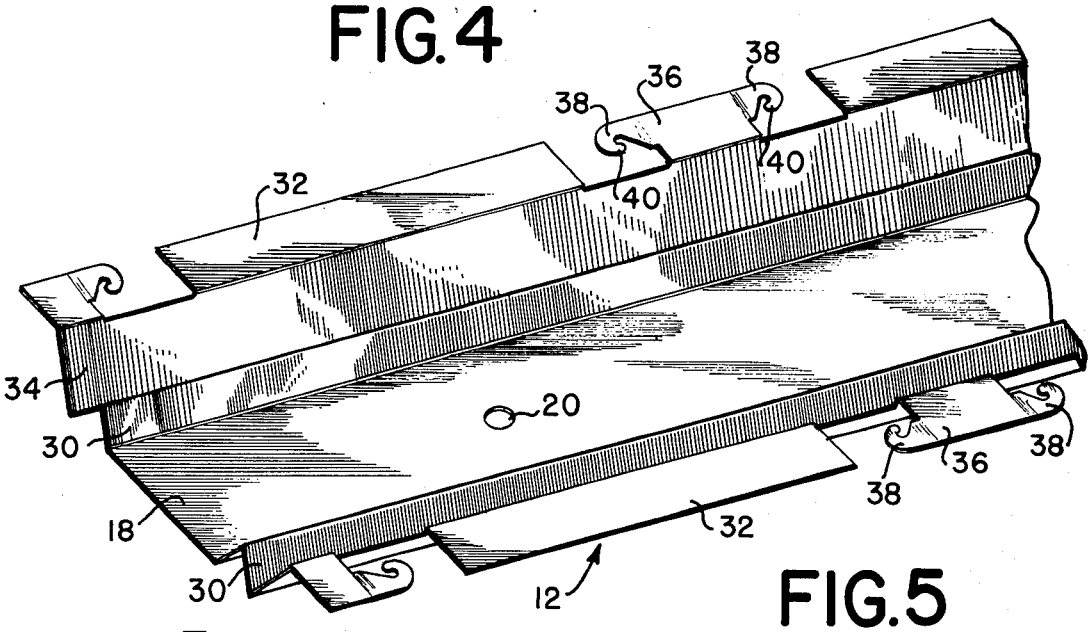
FIG. 5
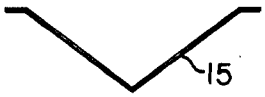
FIG. 8
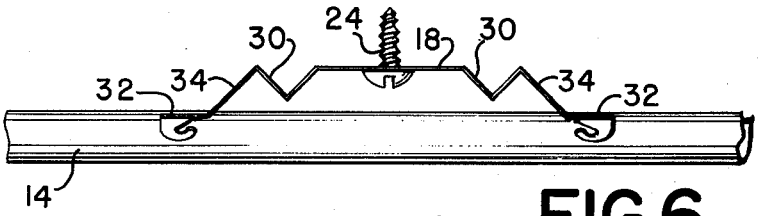
FIG. 6
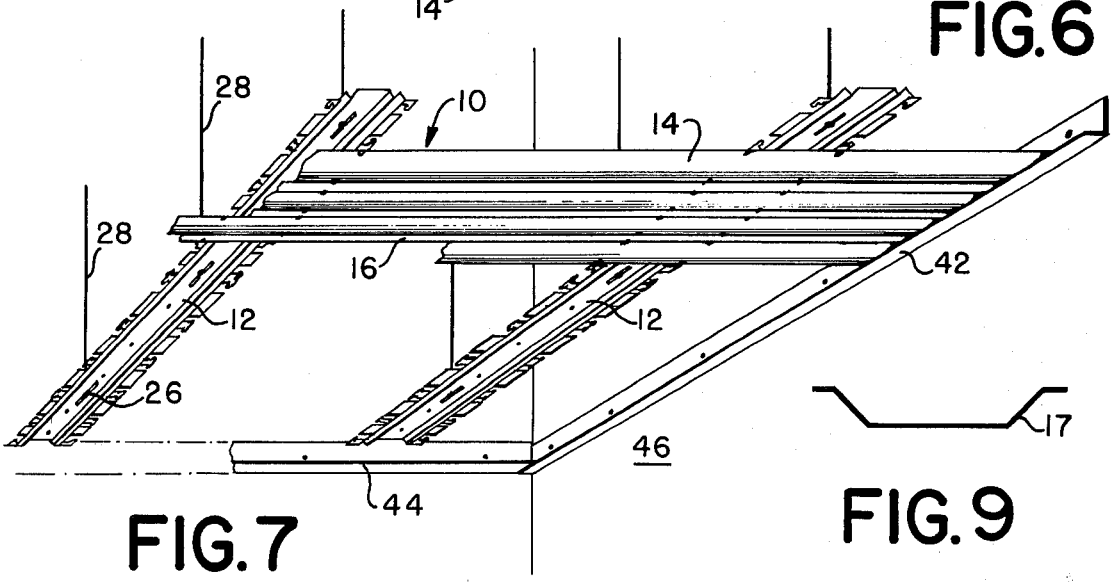
FIG. 7
FIG. 9

DECORATIVE CEILING OR WALL

BACKGROUND OF THE INVENTION

The present invention relates to a decorative ceiling or wall and more specifically is concerned with the provision of an entire decorative ceiling or wall system.

Decorative ceilings in the form of suspended ceilings are known in a variety of forms. However, all prior art systems known to applicant require special installation by an expert and are not suitable for installation in a private home, for instance, to be sold as and installed as a do-it-yourself project. Known prior art suspended ceiling systems, for instance, consist of V- or U-shaped, relatively heavy carriers to which are affixed V- or U-shaped ceiling panels. Such systems require special tools and are relatively expensive. Similar comments apply to decorative walls consisting of the same components.

It is an object of the present invention to provide a ceiling system that can be easily suspended from an existing ceiling or affixed by nails or screws to beams or surfaces of an unfinished room or basement, or to ceilings or walls for renovation work, by means of relatively thin carriers and to which very thin panels of strip material can be affixed, without requiring any tools, other than common scissors, a hammer or screw driver.

Other objects will become apparent from the following description, in connection with the accompanying drawings.

BRIEF DESCRIPTION OF THE DRAWINGS

The invention is illustrated by way of example in the attached drawings, in which:

FIG. 4 is a view similar to that of FIG. 3, but it shows a modified means of connecting the decorative ceiling to a flat surface;

FIG. 5 is a perspective view of the carrier used in the decorative system of the present invention;

FIG. 6 is a section taken along the line 6—6 of FIG. 1;

FIG. 7 is a perspective view of a partially completed ceiling, designed in accordance with the present invention; and FIGS. 8 and 9 are cross-sections of panels modified over those shown in FIGS. 1 to 4.

DETAILED DESCRIPTION OF PREFERRED EMBODIMENTS

Figure 1:
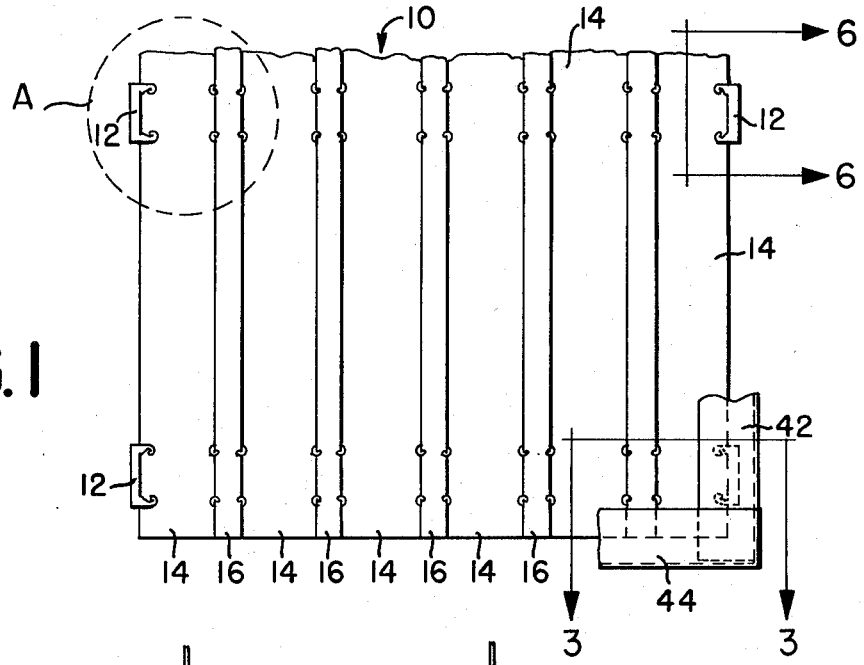
FIG. 1 is a bottom view of one form of a suspended ceiling, according to the present invention, consisting of carriers and panels.

Referring now to the drawings in detail, the invention is illustrated in FIGS. 1 to 9 as being in the form of a suspended ceiling. However, it is to be understood that this is by way of example only, and that the same system can also be used as a decorative wall.

The suspended ceiling 10 shown from the bottom in FIG. 1 and partially completed in the perspective view of FIG. 7, comprises a plurality of carriers 12, only two of which are shown in FIG. 1, because of space limitations. In a ceiling in an ordinary size room, however, many more such carriers may be required, the spacing between carriers being about 3 feet. The carriers will be described later in detail in connection with FIG. 5. The ceiling also comprises a plurality of spaced panels 14 extending transverse to and below the carriers 12. Narrower panels 16 may be provided between the relatively wide panels 14, as shown in FIG. 1, if the ceiling is to be completely closed. However, the narrower panels 16 may be omitted, thus creating an open ceiling.

Figure 3:
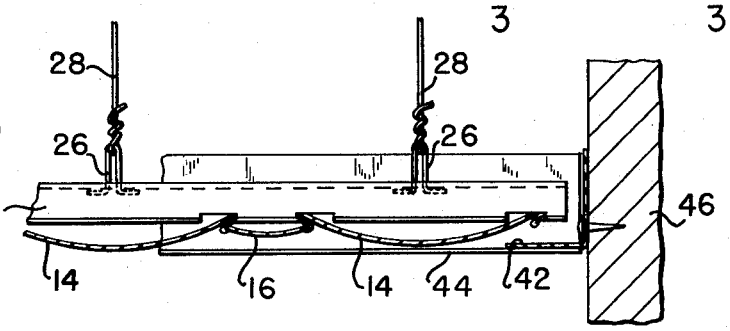
FIG. 3 is a section taken along the line 3—3 of FIG. 1.
Figure 2:
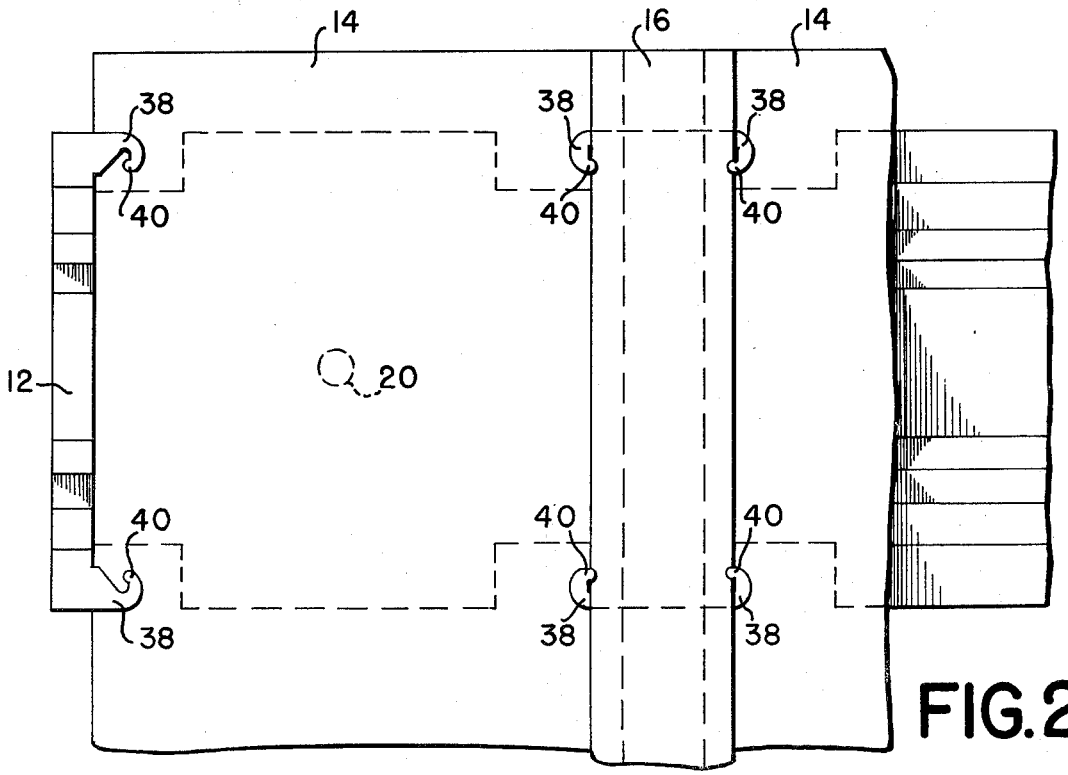
FIG. 2 shows the encircled portion A of FIG. 1 on an enlarged scale.

The ceiling panels 14 and 16 may consist of thin aluminum strips, having for example an approximate thickness of 0.010", so that they can easily be cut to length by an ordinary pair of scissors. They are slightly curved as shown in FIGS. 3 and 4. As a practical example, the wider ceiling panels 14 may be cut from 3.5" wide stock material, such as is used for making vanes of vertical blinds; and the narrower ceiling panels 16 may consist of 25 mm wide stock material widely used as slats in horizontal venetian blinds. Other shapes are adaptable to this system, such as the V-shaped panel 15 of FIG. 8 or the trough-shaped panel 17 of FIG. 9.

The carrier is shown in greater detail in perspective in FIG. 5. It may consist of the same stock material as the panel 14, but has been subjected to a forming process, such as roll-forming, so as to obtain the profile evident from FIG. 5. It can roughly be described as an inverted W with a relatively wide, flat base 18 which is provided with a plurality of spaced bores 20 (only one being shown in FIG. 5). This makes it possible to connect the carrier 12 to an existing ceiling 22 (FIG. 4) by means of screws 24, or to pass therethrough suspending hooks 26 (FIG. 3) which are well-known and by means of which the carrier can be suspended from wires 28 from an existing ceiling or other structure (not shown).

The carrier 12 also has two rib-like portions 30 on opposite sides of base 18 to give the carrier sufficient stiffness, and two relatively flat marginal or flange portions 32. At regular intervals, certain portions have been cut out, for instance by a punching process, from flange portions 32 and adjacent inclined portions 34 of the carrier. This leaves roughly T-shaped panel-holding portions 36 on both sides of the carrier (only two being shown in FIG. 5). The cut-outs have been made in order to provide the carrier 12 with means for supporting and holding the panels 14 and 16 in place. More specifically, with reference to FIGS. 2 and 5, each T-shaped portion 36 includes two opposite tabs 38. When installing the ceiling, the wider panel 14 may be squeezed transverse to its longitudinal extension and placed under tabs 38 facing each other and belonging to adjacent T-shaped portions 36. The respective panel is thus firmly held in place.

On the other hand, the narrower slats 16 when squeezed transversely may be placed underneath the very ends 40 of the tabs 38, which may be slightly bent out of the plane of the flange portions 32. In this way, the panels 14 and 16, or the panels 14 alone, can be attached to the carriers 32. Of course, if the length (or width) of the room requires it several carriers 12 may be placed end to end in abutting relationship or overlapped to maintain accurate spacing for the panels by aligning the holes 20 in the overlapping carriers.

The width of a room parallel to the panels is unlikely to be an exact multiple of the panel spacing so that a gap will remain along one or two opposite walls. Also, as it happens quite frequently, opposite walls in a room are not exactly parallel to each other so that a gap of a varying width is left along one wall. In order to avoid the gaps, in accordance with a further feature of the present invention, angularly bent strips 42 and 44 made from the same stock material as the wider panel 14 may be stapled or nailed to the respective wall 46, and placed above or below the panels 14 and 16, as shown in FIG. 7. It may be sufficient to place strip 42 only on the side where the panels run in the same direction as the wall, and where a gap would be more bothersome. On the other side, where the ends of the panels are close to the wall the gaps may be closed by changing the length of the panels slightly.

As will be evident from the above description and the drawing, the profile of the ceiling or wall covering according to the present invention is very low, less than an inch, and the entire system is extremely light-weight.

An important feature of the invention is that individual panels can easily be removed, without taking down more than one adjacent panel (rather than having to take down all panels starting at one end). More specifically, if the ceiling is open, i.e. only the wider panels 14 are present, they can be disengaged from the tabs by simply squeezing the panel. If the ceiling is composed of wider panels 14 and narrower panels 16, as shown, the narrower panel has to be removed first by squeezing it before the adjacent wider panel can be removed. Easy removal is very important if access need be had to utility lines, electrical wiring and the like.

Another feature consists in that the panels 14, 16 do overlap so as not to leave any gaps therebetween, which gaps may be uneven and unsightly.

The invention is not limited to the particular embodiments shown and described, but encompasses any modifications within the scope of the appended claims.

We claim:

1. A covering system for connection to a ceiling or wall, comprising: at least two carriers, each carrier being an elongated relatively shallow body having a longitudinal axis, a central part extending in a first plane, and two parallel spaced marginal portions extending in a second plane parallel to and spaced from said first plane; each marginal portion having cutouts leaving roughly T-shaped portions in said second plane and spaced from each other laterally of said longitudinal axis at predetermined substantially equal distances, each T-shaped portion having arms oppositely facing with respect to each other in longitudinal direction of the respective marginal portion, pairs of T-shaped portions of opposite marginal portions being aligned with each other transversely to said longitudinal axis, each arm having a tab with an end tip, and a plurality of elongated first slats extending transversely to said at least two carriers, each slat having parallel edge portions respectively removably and positively held between oppositely facing tabs of adjacent T-shaped portions and the respective marginal portion.

2. The system according to claim 1, including second slats of a width narrower than said first slats, said second slats being removably held between the end tips of one and the same T-shaped portion and said T-shaped portion, adjacent second slats partly overlapping adjacent first slats.

3. The system according to claim 1, wherein said slats are slightly curved.

4. The system according to claim 2, wherein said first and second slats are slightly curved.

* * * * *